US007450139B2

(12) United States Patent
Kim

(10) Patent No.: US 7,450,139 B2
(45) Date of Patent: Nov. 11, 2008

(54) IMAGE FORMING APPARATUS, LIGHT SCANNING APPARATUS AND IMAGE FORMING METHOD

(75) Inventor: Young-mi Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 440 days.

(21) Appl. No.: 11/430,853

(22) Filed: May 10, 2006

(65) Prior Publication Data

US 2006/0284959 A1 Dec. 21, 2006

(30) Foreign Application Priority Data

Jun. 15, 2005 (KR) ..... 10-2005-0051512

(51) Int. Cl.
*G03G 15/04* (2006.01)
*B41J 2/447* (2006.01)

(52) U.S. Cl. ..... 347/129; 347/233

(58) Field of Classification Search ..... 347/129, 347/225, 233; 399/46, 51
See application file for complete search history.

(56) References Cited

U.S. PATENT DOCUMENTS 5,546,170 A * 8/1996 Ohba et al. ..... 399/58
5,835,233 A * 11/1998 Otsu et al. ..... 358/3.27
6,266,153 B1 7/2001 Davidson et al.

FOREIGN PATENT DOCUMENTS

| | | |
|---|---|---|
| EP | 0 704 818 | 8/2001 |
| JP | 2003-145831 | 5/2003 |
| KR | 1998-147314 | 5/1998 |
| KR | 2004-462632 | 8/2004 |

OTHER PUBLICATIONS

English language abstract issued Aug. 18, 2004 for Korean Patent Abstract Publication No. 2004-72076.

* cited by examiner

*Primary Examiner*—Huan H Tran
(74) *Attorney, Agent, or Firm*—Stein, McEwen & Bui, LLP

(57) ABSTRACT

An image forming apparatus having a photosensitive drum and a developing roller for coating a developer on the photosensitive drum. The image forming apparatus includes a plurality of light scanning units. Each of the light scanning units scans a light on the photosensitive drum to sharingly form an electrostatic latent image thereon. A selective input unit is provided to select between a normal mode and a saving mode. A controller controls, in the saving mode, a relatively less number of the light scanning units to scan the light on the photosensitive drum, as compared with in the normal mode. Thus, the developer can be saved in a simple and effective way.

15 Claims, 3 Drawing Sheets

IMAGE FORMING APPARATUS, LIGHT SCANNING APPARATUS AND IMAGE FORMING METHOD

CROSS-REFERENCE TO RELATED APPLICATIONS

This application claims the benefit of Korean Application No. 2005-51512, filed Jun. 15, 2005, in the Korean Intellectual Property Office, the disclosure of which is incorporated herein by reference.

BACKGROUND OF THE INVENTION

1. Field of the Invention

Aspects of the present invention relate, in general, to an image forming apparatus and, more particularly, to an image forming apparatus, in which a developer can be efficiently saved.

2. Description of the Related Art

In general, an image forming apparatus includes a paper feeder, an image forming unit, a fixer and a paper discharger. The paper feeder supplies a print paper to the image forming unit, which then selectively coats a developer on the print paper to form a desired image. The fixer fixes the coated developer on the print paper. The paper discharger receives the print paper with the developer fixed from the fixer and discharges it to the outside.

The image forming unit includes a photosensitive drum, a developing roller and a transfer roller to form an image through a desired developing process. A light scanning unit scans a light containing information of a printing image on the photosensitive drum to form an electrostatic latent image thereon. A desired developing bias is applied between the developing roller and the photosensitive drum to thereby form a potential difference in-between. The developing roller selectively supplies the developer on the electrostatic latent image of the photosensitive drum and the transfer roller transfers the developer coated on the photosensitive drum to the print paper.

In general, the developer is stored in a developer storage, which is detachably attached to the main assembly of the image forming apparatus. The developer is stored in the developer storage and supplied to the developing roller. If the entire developer stored in the developer storage is used, a user can remove the developer storage and replace it with a new one filled with developer, or re-fill the developer storage with new developer.

In order to reduce the replacement cost or re-filling cost of a developer storage, an image forming apparatus is provided with a printing mode capable of saving the developer. In the case of this saving mode, more printing jobs can be performed, as compared with a normal mode, although the quality of printing image is degraded. Furthermore, the printing images may not always require a good image quality, i.e., may require a different quality of images, depending upon a degree of importance for the image to be printed. In the case of a lower degree of importance, the printing job for the image can be performed in a saving mode, thus avoiding waste of the developer.

In the conventional image forming apparatus, the light scanning unit adjusts the intensity of scanning light to thereby weaken the electric potential of an electrostatic latent image formed in the photosensitive drum, so that the quantity of the developer to be coated on the photosensitive drum can be reduced. Alternatively, the developing bias of the developing roller is adjusted to reduce the quantity of the developer to be coated on the photosensitive drum. However, this conventional developing-agent saving method results in complexity of the image forming apparatus and also does not result in a significant impact on the amount of developer which is saved.

SUMMARY OF THE INVENTION

Accordingly, it is an aspect of the invention to provide an image forming apparatus, a light scanning apparatus and an image forming method, in which the developer can be saved in simple and efficient manners.

The foregoing and/or other aspects of the present invention are achieved by providing an image forming apparatus comprising a photosensitive drum and a developing roller to coat a developer on the photosensitive drum. The apparatus comprises: a plurality of light scanning units each scanning a light on the photosensitive drum to sharingly form an electrostatic latent image thereon; a selective input unit to select between a normal mode and a saving mode; and a controller to control, in a saving mode, a smaller number of the light scanning units to scan the light on the photosensitive drum, as compared with in a normal mode.

According to an exemplary embodiment of the present invention, the light scanning units each may scan the light along longitudinal directions of the photosensitive drum linearly in parallel to one another.

According to an aspect of the present invention, the selective input unit may divide the saving mode into a plurality of saving steps, and the controller may control to operate a different number of the light scanning units, correspond to each saving step selected through the selective input unit.

The foregoing and/or other aspects of the present invention are also achieved by providing a light scanning apparatus having a photosensitive drum, the apparatus comprising: a plurality of light scanning units each scanning a light on the photosensitive drum to sharingly form an electrostatic latent image thereon; a selective input unit for selecting either a normal mode or a saving mode; and a controller for controlling, in the saving mode, a relatively less number of the light scanning units to scan the light on the photosensitive drum, as compared with in the normal mode.

The foregoing and/or other aspects of the present invention are also achieved by providing an image forming method in an image forming apparatus having a photosensitive drum, the method comprising: providing a plurality of light scanning units, each of the light scanning units scanning a light on the photosensitive drum to sharingly form an electrostatic latent image thereon; selecting either a normal mode or a saving mode; and controlling, in the saving mode, a relatively less number of the light scanning units to scan the light on the photosensitive drum, as compared with in the normal mode.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
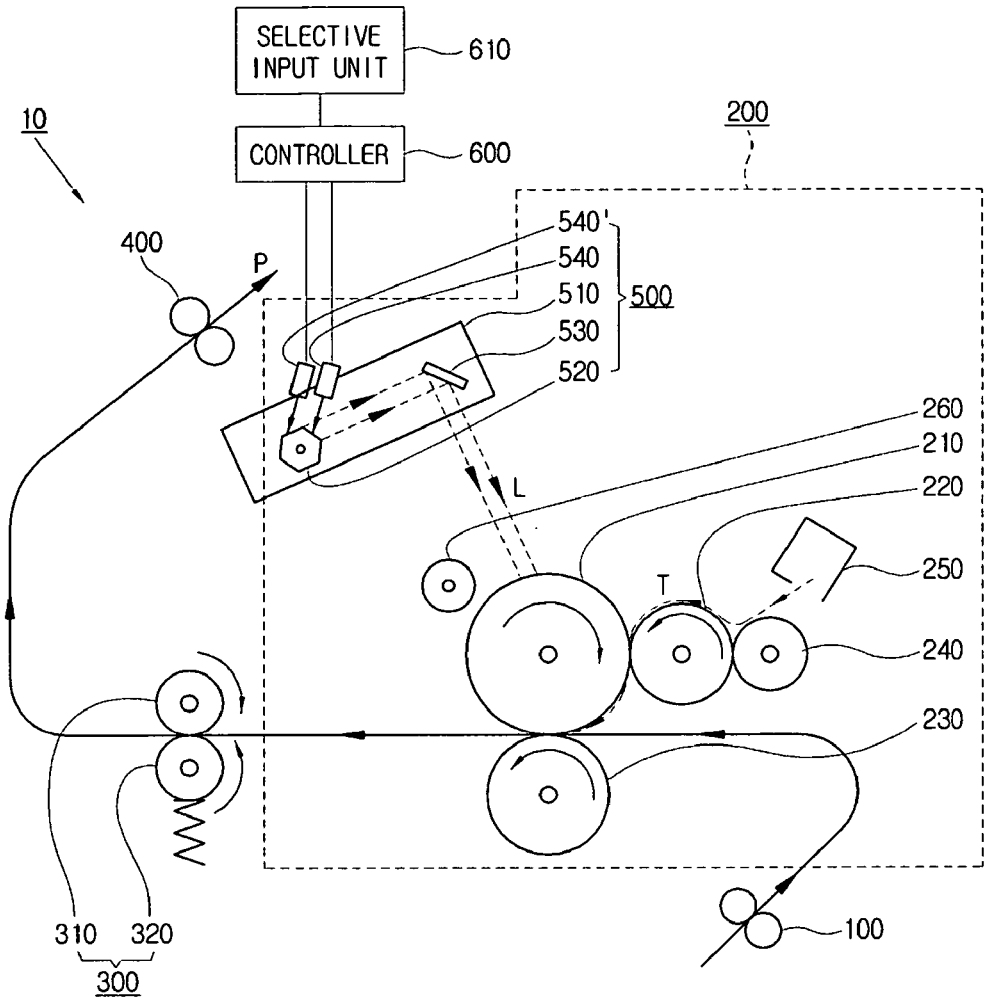
FIG. 1 is a schematic view showing an image forming apparatus according to an embodiment of the invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
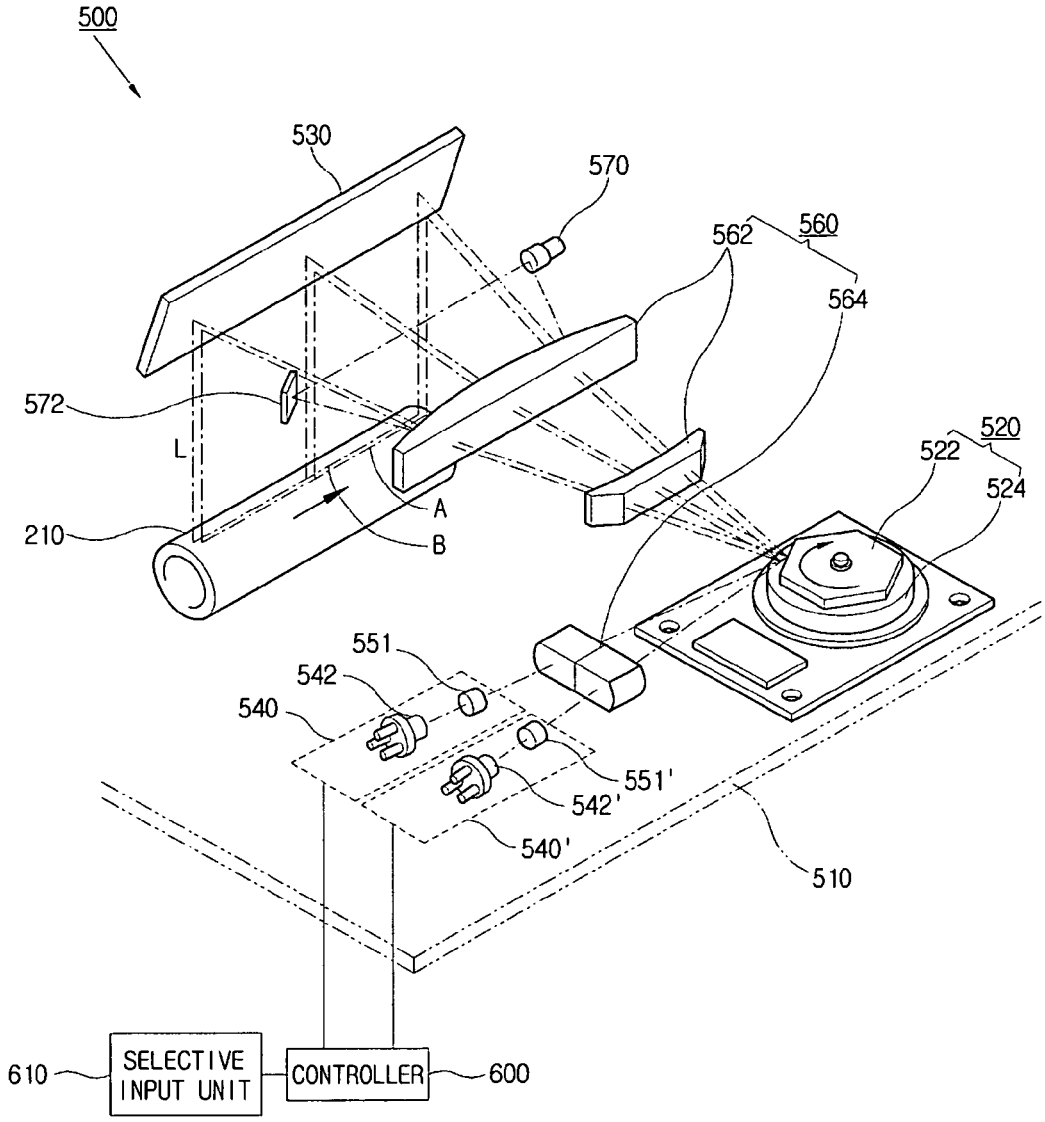
FIG. 2 shows major parts in the image forming apparatus of FIG. 1.

FIG. 1 is a schematic view showing an image forming apparatus 10 according to an embodiment of the invention. FIG. 2 shows major parts in the image forming apparatus 10 of FIG. 1. As illustrated in FIGS. 1 and 2, the image forming apparatus 10 includes a paper feeder 100, an image forming unit 200, a fixer 300 and a paper discharger 400. The paper feeder 100 feeds a print paper P to the image forming unit 200. The image forming unit 200 selectively coats a developer T on the print paper P using electric potential to thereby form a desired image on the print paper P. The fixer 300 fixes the developer T on the print paper P. The paper discharger 400 receives the print paper T from the fixer 300 and discharges it to the outside. Of course, print media other than the print paper P may be used to fix images thereon in the image forming apparatus 10, such as overhead sheets, transparencies, etc.

The image forming unit 200 includes a photosensitive drum 210, a light scanning unit 500, a charge roller 260, a developing roller 220 and a transfer roller 230. The photosensitive drum 210 rotates to perform a desired developing process while rotating in contact with the charger roller 260, the light scanning unit 500, the developing roller 220 and a transfer roller 230 in turn. The charge roller 260 charges the surface of the photosensitive drum 210 to be negatively charged, and then the light scanning unit 500 scans light L on the photosensitive drum 210 to thereby form an electrostatic latent image. A feeder roller 240 receives the developer T from a developer storage 250 and supplies it to the developing roller 220. The developing roller 220 selectively coats the developer T only on the electrostatic latent image formed on the photosensitive drum 210. The transfer roller 230 transfers the developer T (coated on the photosensitive drum 210) onto the print paper P as the print P passes between the photosensitive drum 210 and the transfer roller 230.

The fixer 300 includes a heating roller 310 and a pressing roller 320, which rotate so as to face each other with the print paper P in-between. The heating roller 310 is provided with a heater, and the pressing roller 320 is provided with a pressurizing member. The fixer 300 receives the print paper P coated with the developer T from the image forming unit 200 and simultaneously, the heating roller 310 and the pressing roller 320 heat up and pressurize, respectively, the print paper P. Accordingly, the developer T is fusion-pressed and fixed on the print paper P to thereby form a printing image.

The image forming apparatus 10 of this embodiment is provided with a light scanning device 500 having a plurality of light scanning units 540 and 540'. The light scanning device 500 of FIGS. 1 and 2 illustrates two light scanning units 540 and 540', but the invention is not limited thereto, as additional light scanning units may be incorporated into the image forming apparatus 10. For the convenience of description, the light scanning device 500 illustrates two light scanning units, i.e., a first light scanning unit 540 and a second light scanning unit 540'.

The light scanning device 500 includes the light scanning units 540, 540', a polygon mirror assembly 520, a reflective mirror 530, an optical lens system 560, and a frame 510 supporting these elements. Each light scanning unit 540, 540' is provided with a light source 542, 542' for emitting and radiating light L, and a collimator lens 551, 551' to adjust the radiated light L to be parallel to the light axis. Each of the light sources 542 and 542' may include a laser diode. The polygon mirror assembly 520 includes a polygon mirror 522 having a plurality of reflective surfaces and a driver 524 for rotating the polygon mirror 522 with a high and constant velocity. The optical lens system 560 may include a cylindrical lens 564 and a scanning lens 562 spaced apart from each other.

The cylindrical lens 564 is interposed between the light scanning units 540 and 540' and the polygon mirror 522 such that the light L radiated from the light scanning units 540 and 540' can be converged in a sub-scanning direction. The polygon mirror 522 receives light passing through the cylindrical lens 564 and reflects the light so as to form a desired imaging angle, while rotating with a high speed by the driver 524. The scanning lens 562 converges the light L reflected from the polygon mirror 522 in a main scanning direction. The reflective mirror 530 reflects the light L passing through the scanning lens 562 into a desired direction to resultantly form an image on the photosensitive drum 210. An optical mirror 570 senses the reflected light from a synchronous mirror 572 to ensure synchronous scanning of the light scanning units 540 and 540'.

Each of the light scanning units 540 and 540' scans desired light L respectively in such a manner to sharingly form an electrostatic latent image on the photosensitive drum 210. The first light scanning unit 540 and the second light scanning unit 540' radiate the light on the photosensitive drum 210 not to be overlapped with each other. Accordingly, the first light scanning unit 540 and the second light scanning unit 540' form an electrostatic latent image in different areas respectively on the photosensitive drum 210, and the electrostatic latent images formed by the first and second light scanning units 540 and 540' are combined to form a desired single electrostatic latent image. Of course, the first and second light scanning units 540 and 540' may scan the light so as to be overlapped in a specific area of the photosensitive drum 210.

Each light scanning unit 540, 540' may scan the light along the longitudinal direction of the photosensitive drum 210 in parallel to each other. The first light scanning unit 540 may scan the light along a longitudinal line A of the photosensitive drum 210 to form part of the electrostatic latent image, and the second light scanning unit 540' may scan the light along an adjacent longitudinal line B thereof to thereby form another part of the electrostatic latent image.

The plural light scanning units 540 and 540' may be disposed non-parallel to the frame 520, dissimilar to FIGS. 1 and 2. The light scanning units 540 and 540' may be disposed in various positions relative to each other. In addition, each of the light scanning units 540 and 540' may be provided with a separate cylindrical lens 564 respectively, without using the same cylindrical lens 564, as illustrated in the figures. Furthermore, each light scanning unit 540, 540' may be provided with a separate polygon mirror assembly 520 respectively.

A selective input unit 610 is provided such that either a normal mode or a saving mode can be selected. In the saving mode, a printing job is performed in a developer saving manner, and in the normal mode, the printing job is carried out in a normal way. The selective input unit 610 may be a user operation panel (OPE, not shown), in which a user can select the mode through a key input of a key pad. Alternatively, the user may select the mode through a host (not shown) connected to the image forming apparatus 10.

In the case of the normal mode, a controller 600 allows both the first and second light scanning units 540 and 540' to scan the light. The first and second light scanning units 540 and 540' are configured such that they scan respectively the lines A and B parallel to each other to sharingly form an electrostatic latent image on the photosensitive drum 210. In this way, the first and second light scanning units 540 and 540' repeat the above parallel light scanning to thereby form an electrostatic latent image on the rotating photosensitive drum 210. Thus, the entire electrostatic latent image to be printed can be formed and the developer is supplied from the developing roller 240 to form the electrostatic latent image or the photosensitive drum 240 to thereby form a print image having a normal quality.

In the case of the saving mode, the controller 600 operates in such a way that less number of light scanning units 540 and 540', compared with the normal mode, scan light on the photosensitive drum 210. In the saving mode, the controller 600 may control the first light scanning unit 540 to scan the light and second light scanning unit 540' not to scan the light, or vice versa. Alternatively, the controller 600 may be configured to variably select either one of the first and second light scanning units 540 and 540' to scan the light. Thus, either way, the controller 600 controls the light scanning units 540, 540' to operate at less than normal operation in the saving mode as compared with the light scanning units 540, 540' operating at the normal operation in the normal mode.

Therefore, only part of the light scanning units 540 and 540' scan light to form an electrostatic latent image on the photosensitive drum 210, so that the quantity of the developer transferred to the photosensitive drum 210 from the developing roller 220 can be significantly reduced. Thus, although the image quality is somewhat degraded, the printing job can be efficiently carried out in a developer saving mode. This is due to the fact that the user does not mind printing images of lesser quality in certain circumstances.

In a case where the number of the light scanning units 540 is K(K>2), the controller 600 may perform control such that a desired N(0<N≦K) number of light scanning units 540 are operated in the normal mode, and a desired M(0<M≦N) number of light scanning units 540 are operated in the saving mode.

In a case where the number of the light scanning units 540 is K(K>2), the saving mode may be divided into a plurality of saving operations depending upon a desired saving level of the developer. Then the selective input unit 610 may perform control such that a different number of light scanning units 540 are operated, depending upon the desired saving level of the developer. For example, if a user selects a higher saving operation, the controller 600 minimizes the number of the light scanning units 540 to be operated. If a user selects a lower saving operation, the controller 600 can maximize the number of the light scanning unit to be operated. Here, the number of the light scanning units to be operated should be less than that in the normal mode.

Hereafter, a light scanning device according to an embodiment of the invention will be explained, referring to FIG. 2. As illustrated in FIG. 2, the light scanning device 500 is provided with the light scanning units 540, 540', a selective input unit 610 and a controller 600. Each of the light scanning units 540 and 540' scans a desired light to sharingly form an electrostatic latent image on the photosensitive drum 210. The selective input unit 610 is configured to select either a normal mode or a saving mode. The controller 600 performs control such that smaller number of the light scanning units 540 and 540' scan light on the photosensitive drum 210 in the saving mode, as compared with the normal mode.

Hereafter, an image forming method according to an embodiment of the invention will be explained.

Figure 3:
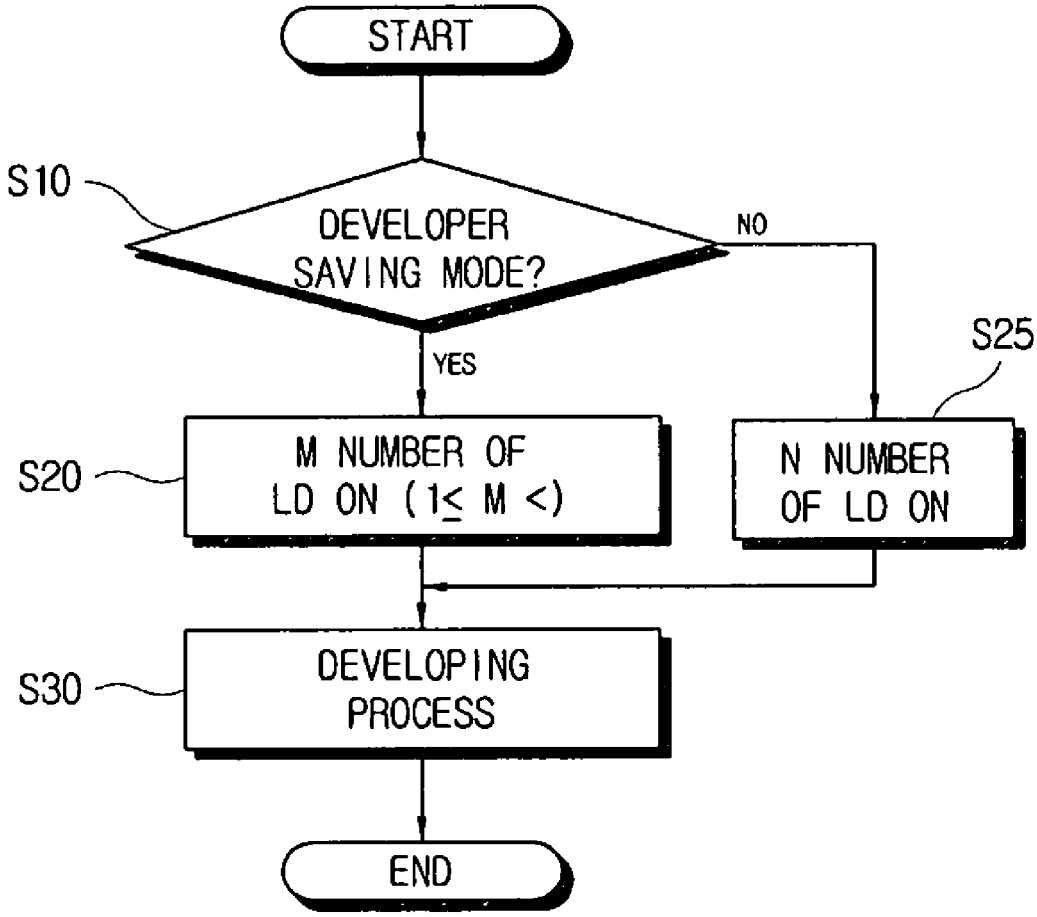
FIG. 3 is a flow chart showing an image forming method according to an embodiment of the invention.

FIG. 3 is a flow chart showing an image forming method according to an embodiment of the invention. As shown in FIG. 3, in the image forming method of an image forming apparatus having a photosensitive drum, first, a plurality of light scanning units is provided, each of which scans a desired light to thereby sharingly form an electrostatic latent image on the photosensitive drum 210. Thereafter, either a normal mode or a saving mode is selected (S10).

In the case of the normal mode being selected, a desired N number of light scanning units are turned on to scan light on the photosensitive drum 210 (S25). In the case of a saving mode, a desired M(1≦M<N) number of light scanning units, which is less than that in the normal mode, are turned on to scan light on the photosensitive drum (S20).

A desired developing process is performed, where developer T is supplied to the electrostatic latent image (formed on the photosensitive drum 210), which is transferred to a print paper (S30).

The image forming apparatus according to aspects of the present invention may include a printer, a copying machine, a facsimile, a combined all-in-one machine, or other similar devices.

As described above, according to the image forming apparatus, the light scanning apparatus and the image forming method of the invention, in the case of a saving mode, a smaller number of light scanning units are selected to scan light on the photosensitive drum, as compared with a normal mode, thereby enabling a reduction in the quantity of the developer to be coated on the photosensitive drum. Therefore, the developer can be saved in a simple and effective manner.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An image forming apparatus comprising:

a photosensitive drum;

a developing roller to coat a developer on the photosensitive drum;

a plurality of light scanning units each scanning a light on the photosensitive drum to sharingly form an electrostatic latent image thereon;

a selective input unit to select between a normal mode and a saving mode; and a controller to control, in the saving mode, a smaller number of the light scanning units to scan the light on the photosensitive drum, as compared with in the normal mode.

2. The apparatus as set forth in claim 1, wherein the light scanning units each scans the light along longitudinal directions of the photosensitive drum linearly in parallel to one another.

3. The apparatus as set forth in claim 1, wherein the selective input unit divides the saving mode into a plurality of saving operations, and the controller operates a different number of the light scanning units according to the saving operations selected through the selective input unit.

4. The apparatus as set forth in claim 1, wherein the selective input unit comprises a key pad on the apparatus.

5. The apparatus as set forth in claim 1, wherein the selective input unit receives the selection from a host external of the apparatus.

6. A light scanning apparatus having a photosensitive drum, the apparatus comprising:

a plurality of light scanning units each scanning a light on the photosensitive drum to sharingly form an electrostatic latent image thereon;

a selective input unit to select between a normal mode and a saving mode; and a controller to control, in the saving mode, a smaller number of the light scanning units to scan the light on the photosensitive drum, as compared with in the normal mode.

7. The apparatus as set forth in claim 6, wherein the light scanning units each scans the light along longitudinal directions of the photosensitive drum linearly in parallel to one another.

8. The apparatus as set forth in claim 6, wherein the selective input unit divides the saving mode into a plurality of saving operations, and the controller operates a different number of the light scanning units according to the saving operations selected through the selective input unit.

9. The apparatus as set forth in claim 6, wherein the plurality of light scanning units comprises first and second light scanning units which radiate light in an interleaved manner so as not to overlap with each other.

10. The apparatus as set forth in claim 6, wherein the plurality of light scanning units comprises first and second light scanning units which radiate light in a manner so as not to overlap with each other at portions of the electrostatic latent image, and to overlap with each other at another portion of the electrostatic image.

11. An image forming apparatus comprising:

a photosensitive drum;

a plurality of light scanning units each scanning a light on the photosensitive drum to sharingly form an electrostatic latent image thereon; and a controller to control, in a saving mode, the light scanning units to operate at less than at normal operation, as compared with the light scanning units operating at the normal operation in a normal mode.

12. The apparatus as set forth in claim 11, wherein the controller controls a smaller number of the light scanning units to scan the light onto the photosensitive drum in the saving mode, as compared with in the normal mode.

13. The apparatus as set forth in claim 12, wherein the light scanning units scan the corresponding light to be parallel and adjacent to each other on the photosensitive drum.

14. The apparatus as set forth in claim 11, wherein the controller controls the light scanning units to selectively variably operate in the saving mode, and controls the light scanning units to fully operate in the normal mode.

15. The apparatus as set forth in claim 14, wherein the light scanning units scan the corresponding light to be parallel and adjacent to each other on the photosensitive drum.

* * * * *